US005282986A

United States Patent [19]

Otake et al.

[11] Patent Number: 5,282,986

[45] Date of Patent: Feb. 1, 1994

[54] GREASE FOR A SLIDE CONTACT

[75] Inventors: Sugako Otake; Hiroaki Takahashi, both of Aichi; Toshiaki Endo, Fujisawa; Mitsuhiro Kakizaki, Hiratsuka, all of Japan

[73] Assignees: Kabushiki Kaisha Tokai Rika Denki Seisakusho, Aichi; Kyodo Yushi Co., Ltd., Tokyo, both of Japan

[21] Appl. No.: 995,882

[22] Filed: Dec. 23, 1992

[30] Foreign Application Priority Data

Dec. 27, 1991 [JP] Japan ..... 3-346169

[51] Int. Cl.[5] ..... C10M 107/22; C10M 169/00

[52] U.S. Cl. ..... 252/18; 252/21; 252/25; 252/28; 252/56 S

[58] Field of Search ..... 252/18, 21, 28, 25, 252/56 S

[56] References Cited

U.S. PATENT DOCUMENTS

| | | | |
|---|---|---|---|
| 4,298,481 | 11/1981 | Clarke | 252/21 |
| 4,406,800 | 9/1983 | Christian | 252/21 |
| 4,749,502 | 6/1988 | Alexander et al. | 252/56 S |
| 4,840,739 | 6/1989 | Mori et al. | 252/21 |
| 5,173,204 | 12/1992 | Chiddick et al. | 252/28 |

*Primary Examiner*—Jacqueline V. Howard

*Attorney, Agent, or Firm*—Birch, Stewart, Kolasch & Birch

[57] ABSTRACT

The present invention provides a grease for a slide contact which comprises (i) a synthetic hydrocarbon oil, (ii) 0.2–3.0 parts by weight of at least one inorganic substance whose mean particle size is 0.36 $\mu$ or less, selected from the group consisting of zinc oxide, ferric oxide, and clay minerals which produce magnesium oxide through thermal decomposition thereof at high temperature, (iii) 3–20 parts by weight of 12-hydroxy lithium stearate, and (iv) 0.1–5.0 parts by weight of phenolic and/or amine primary antioxidants, said blending amounts of the ingredients being based on 100 parts by weight of the grease.

10 Claims, 7 Drawing Sheets

GREASE FOR A SLIDE CONTACT

FIELD OF THE INVENTION

This invention relates to a grease for a slide contact used for a sliding switch and the like.

BACKGROUND OF THE INVENTION

A grease for a slide contact has been used for a sliding switch and the like of a vehicle such as an automobiles and the like. The following properties are required of the grease in particular because it is troublesome and cost much labor to apply the grease to slide contact parts and slide parts made of resins respectively:

(i) It indicates low frictional resistance when it is applied to the slide parts made of resins or metals.

(ii) It does not affect Environment Stress Crack of slide parts made of resins.

(iii) It does not corrode the contact parts made of metals such as copper, and maintains low contact resistance of the contact parts under corrosive environments such as high temperature and humidity conditions.

(iv) It extinguishes arc generated at the time of switching a load-break when it is applied to breaking parts of the slide contact, and is hard to deteriorate and carbonize under arc heat.

(v) It does not change in quality at the temperatures used for soldering a lead wire, and makes a process for soldering the lead wire possible after it is applied to the slide contact.

In addition to the above, the following property is required of the grease from the viewpoint that a poor dispersion of the ingredients, a bad injection of the grease from an autoapplicator, and the presence of the grease applied to members made of white or whitey resins, which constitute the switch, can visually be confirmed:

(vi) It can comprise a coloring agent without losing the aforementioned properties (i)-(v).

Although a grease for a slide contact possessing the aforesaid properties (i)-(v) (cf. U.S. patent application Ser. No. 07/753,374), there is yet room for improvement in the property (iv), and increase of a repeated durability of the switch is required of said grease in particular. Furthermore, as said grease is nearly colorless, the poor dispersion of ingredients, and the like cannot be confirmed visually.

OBJECT OF THE INVENTION

The present invention has been made in order to provide for a slide contact grease which satisfies all the aforesaid requirements (i)-(vi), of the grease, including the improved requirement (iv).

SUMMARY OF THE INVENTION

The present invention provides a grease for a slide contact which comprises (i) a synthetic hydrocarbon oil, (ii) 0.2-3.0 parts by weight of at least one inorganic substance whose mean particle size is 0.6 $\mu$ and below, selected from the group consisting of zinc oxide, ferric oxide, and clay minerals which produce magnesium oxide through thermal decomposition thereof at high temperature, (iii) 3-20 parts by weight of 12-hydroxy lithium stearate, and (iv) 0.1-5.0 parts by weight of phenolic and/or aminic primary antioxidants, the blending amounts of the ingredients being based on 100 parts by weight of the grease.

Figure 1:
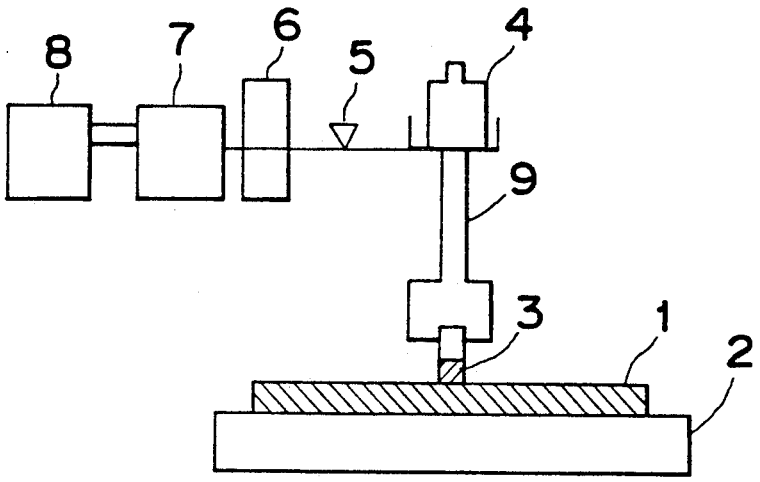
FIG. 1 is a schematic constructional view of the measuring apparatus for dynamic coefficient of friction.

The synthetic hydrocarbon oils are used as a base oil of the grease according to the present invention. They are synthetic lubricating oils consisting of carbon atoms and hydrogen atoms. Typical synthetic hydrocarbon oils are poly-$\alpha$-olefin, co-oligomers of ethylene and another $\alpha$-olefins, polybutene, and like. As they have no polar groups in the molecules, they guarantee a compatibility of the grease with almost all the resins.

Kinematic viscosity of the synthetic hydrocarbon oils which are commonly used as a base oil is 1.7-10 cSt/100° C. By using the synthetic hydrocarbon oils, sufficient lubricity can be obtained at a low temperature, such as −50° C. If necessary, at most about 10 percent by weight of the synthetic hydrocarbon oil whose kinematic viscosity is 40 cSt/100° C. and over may be blended with the base oil. By blending said oil having high viscosity, frictional resistance at the time of sliding decreases, and operational function increases as the coated oil film of the grease becomes thicker.

At least one inorganic substance whose mean particle size is 0.6 μ and less is blended with the grease according to the present invention, said inorganic substance being selected from the group consisting of zinc oxide, ferric oxide, and clay minerals which produce magnesium oxide through their thermal decomposition at high temperatures. Fine particles of the inorganic substance bring about the following effects, such as (a) extinction of arc, (b) prevention of grease deterioration, and (c) an insulating deterioration of the metallic contact:

(a) The aforesaid inorganic substances act as a dehydrogenation catalyst at the time of arc generation under high temperatures, and accelerate the generation of hydrogen gas at the time of thermal decomposition of the base oil, said generated hydrogen gas being effective for the extinction of arc. It is known that hydrogen gas is effective for the extinction of arc (e.g. Japanese Patent KOKAI No. 276724/1987 wherein an apparatus for extinguishing arc equipped with polymethylpentene resin which produces a large quantity of hydrogen gas through its thermal decomposition, said produced hydrogen gas being effective for the extinction of arc).

(b) The aforementioned inorganic substances prevent the grease deterioration as they effectively absorb ultraviolet ray generated together with arc, said generated ultraviolet ray bringing about deterioration of organic substances.

(c) In the neighborhood of the insulator of contact breaking point the cathode side of the sliding switch, arc plasma positive ions of the contact metal are irradiated to form the metallic foil. Although the growth of the metallic foil brings about the insulating deterioration of the metallic contact, the aforementioned inorganic substances effectively prevent the growth of the metallic foil and delay the insulating deterioration of the matallic contact because they absorb the arc plasma positive ions and disperse said ions in the grease.

Usually, the mean particle size of the aforesaid inorganic substance does not exceed 0.3 μ, preferably 0.1 μ. When the mean particle size of the inorganic substance is more than 0.6 μ, the frictional resistance of the grease becomes high. The particulate zinc oxide having such a particle size can readily be commercially available at a low price.

The blending amounts of the particulate inorganic substance are 0.2–3.0 parts by weight, preferably 0.4–1.0 part by weight, per 100 parts by weight of the grease. When the blending amounts of the particulate inorganic substance are less than 0.2 part by weight, the aforesaid effects (a)–(c) cannot be obtained. If the blending amounts of the particulate inorganic substance are more than 3.0 parts by weight, low frictional resistance cannot be kept.

As the thickener of the grease according to the present invention, 12-hydroxy lithium stearate is used. By blending 12-hydroxy lithium stearate, a greasy state can be maintained without being hardened after cooling, even if the grease is melted by heating it to temperatures higher than the dropping point (ca. 200° C.) of the grease.

The blending amounts of 12-hydroxy lithium stearate are 3–20 parts by weight, preferably 8–15 parts by weight, per 100 parts by weight of the grease. When the blending amounts of 12-hydroxy lithium stearate are less than 3 parts by weight, the tackiness of the grease is decreased, the oil-separating property of the grease is increased, and antifriction of the sliding parts to which the grease is applied becomes worse. If the amounts of the thickener are more than 20 parts by weight, lubricity and application property of the grease are decreased.

Phenolic and/or amine primary antioxidants employed in the present invention are particularly suitable to the grease for copper slide contact. In particular, heat-resistant, phenolic and/or amine primary antioxidants are preferable because the grease for the copper slide contact is heated to the temperature of more than ca. 180°–200° C. for a short time in the soldering process of lead wire and the like.

As the phenolic or amine primary antioxidant, 2,6-di-t-buty-4-methyl phenol, 4,4-thiobis (3-methyl-6-t-butyl phenol), alkylated diphenylamine and the like are exemplified.

The blending amounts of the phenolic and/or amine primary antioxidants are 0.1–5.0 parts by weight, preferably 0.3–2.0 parts by weight, per 100 parts by weight of the grease. When the amounts of the antioxidants are less than 0.1 part by weight, sufficient antioxidative effect cannot be obtained. It is useless to blend more than 2.0 parts by weight of the antioxidants.

Oil-soluble diazo dyes, such as Solvent Red 24 (color index number) and the like may be incorporated with the grease according to the present invention from the viewpoint that a poor dispersion of the ingredients, a bad injection of the grease, and the presence of the grease on the slide contact can visually be confirmed. The oil-soluble diazo dyes make said visual confirmation possible without influencing the aforementioned properties (i)–(v).

The blending amounts of the oil-soluble diazo dyes are usually 0.001–0.3 part by weight. When the amounts of the diazo dyes are less than 0.001 part by weight, enough coloring effect cannot be obtained. Blending more than 0.3 part by weight of the diazo dyes is useless and is not preferable as inconveniences such as soiling of working clothes by the crimson dyes and the like occur.

As the additional effect achieved by blending the oil-soluble diazo dyes with the grease, application range of the aforementioned inorganic substances such as zinc oxide and the like can be widened. As mentioned before, the mean particle size of the inorganic substances does usually not exceed 0.3 μ, and the blending amounts of the inorganic substances are 0.2–3.0 parts by weight. However, incorporation of the oil-soluble diazo dyes brings about a wider application range of the inorganic substances wherein 0.2–5.0 parts by weight of the inorganic substance whose mean particle size does not exceed 0.6 μ can be incorporated with the grease. As definitely shown later by comparison of frictional resistance of the grease 3 with that of the grease 4', decreasing effect of friction coefficient of the grease depends on the presence of the diazo dyes.

In addition to the aforementioned ingredients, conventional additives such as metal activators (e.g. benzotriazole, driazoles and derivatives thereof) and the like may, if necessary, be blended to the slide contact grease according to the present invention.

The present invention is illustrated by the following examples.

Example 1-5 and Comparative Examples 1-7

According to the blending prescriptions shown in Table 1, the greases 1-5 (Examples 1-5) and the greases 1'-7' (Comparative Examples 1-7) were prepared by the conventional method. Properties of these greases are also shown in Table 1.

TABLE 1

| Ingredients or properties of the greases | | Greases | | | | | | | | | | | |
|---|---|---|---|---|---|---|---|---|---|---|---|---|---|
| | | Examples | | | | | Comparative Examples | | | | | | |
| | | 1 | 2 | 3 | 4 | 5 | 1' | 2' | 3' | 4' | 5' | 6' | 7' |
| Ingredients (parts by weight) | Synthetic poly-α-olefin oil [1] | | | 100 | | | | | | 100 | | | |
| | 12-Hydroxy lithium stearate | | | 10 | | | | | | 10 | | | |
| | ZnO (0.005-0.015 μ) | — | 0.5 | — | — | 0.5 | — | — | — | — | — | — | 0.2 |
| | ZnO (0.1-0.2 μ) | 1.0 | — | — | 0.5 | — | — | — | — | — | — | — | — |
| | ZnO (0.4-0.6 μ) | — | — | 0.5 | — | — | — | — | — | 0.5 | 0.5 | 2.0 | — |
| | Benzotriazole | | | 0.1 | | | | | | 0.1 | | | |
| | 2,6-di-t-butyl p-cresol | | | 1.0 | | | | | | 1.0 | | | |
| | Oil-soluble monoazo dye [2] | — | — | — | — | — | — | 0.02 | — | — | — | — | — |
| | Organic molybdenum [3] | — | — | — | — | — | — | — | — | — | 0.5 | 0.5 | — |
| | Oil-soluble diazo dye [4] | — | 0.01 | 0.01 | — | — | — | — | 0.01 | — | — | — | 0.01 |
| Properties | Worked penetration | 270 | 281 | 275 | 272 | 270 | 288 | 278 | 272 | 282 | 275 | 272 | 270 |
| | Dropping point (°C.) | 208 | 208 | 206 | 207 | 208 | 208 | 208 | 208 | 207 | 206 | 207 | 208 |
| | Evaporation loss (%) [99° C.; 22 h] | 0.63 | 0.62 | 0.62 | 0.64 | 0.62 | 0.47 | 0.51 | 0.64 | 0.64 | 0.65 | 0.61 | 0.62 |
| | Oil separation (%) [100° C.; 24 h] | 2.3 | 2.9 | 2.6 | 2.7 | 2.7 | 4.4 | 4.2 | 2.7 | 2.8 | 2.9 | 2.7 | 2.6 |

[1] 6cSt/100° C.;
[2] Solvent Yellow 56 (color index number);
[3] molybdenum dithioalkyl carbamate; Solvent Red 24 (color index number)

The properties of the greases, such as the dynamic friction coefficient, resin compatibility, corrosive property for the copper plate, durability for ON-OFF action of the switch, durability for soldering, and colorability were measured by the methods described hereinafter. The results of the measurements are shown in the following Table 2.

(1) Dynamic friction coefficient

The grease sample was applied to the surface of the molded flat board (100 mm×150 mm×3 mm) made of the ABS resin 42, which is commercially available from Nihon Gosei Gomu Co., Ltd., the applied grease was wiped off twice with "Kim Towel" made of wood pulp, which is commercially available from Jujo Kimberley Co., Ltd., and then the dynamic friction coefficient of the remained grease on the surface was determined in accordance with ASTM-D 1894 by means of HIDON-14 type apparatus for measuring surface properties (Shinto Kagaku Co., Ltd.). In FIG. 1, the flat board (1) is fixed to a movable plate (2) which can uniformly be moved by means of a motor. In FIG. 1, (3), (4), (5), (6), (7), (8), and (9) indicate a slide piece (5 ϕ×3 mm) made of the ABS resin 42, a load (100 g), a fulcrum of a balance, a balance weight, a strain gauge (maximum load: 200 g, output: 5.0 V), 3655 E type analyzing recorder (output : 0.6 V) (Yokokawa Denki Co., Ltd.), and a sample holder respectively. The measurement was carried out at the sliding speed of 25 mm/ min at 28° C. The meanings of the marks for the dynamic friction coefficient appeared in Table 2 are as follows:

"○": The mean value is about 0.15.
"Δ": The mean value is about 0.20.
"x": The mean value is 0.24 or more.

(2) Resin compatibility

The grease sample was applied to the test piece (0.5 in×0.25 in×5 in) made of ABS resin 42. Maximum bending strain (δ) of 1 mm, 2 mm or 3 mm was put upon the applied test piece according to ASTM-D638 and an examination for the presence of a crack was made after 3 hours at 75° C. The mark "○" for the resin compatibility shown in Table 2 means that there is no difference between the applied test piece and the test piece to which no grease was applied.

(3) Corrosive property for the copper plate

Figure 2:
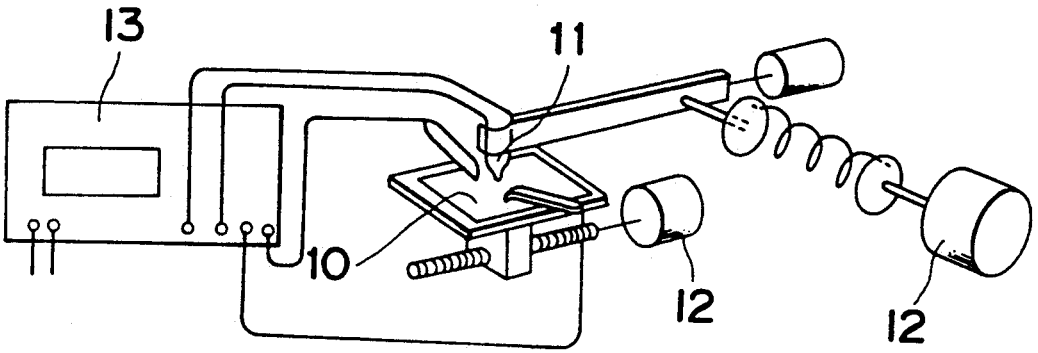
FIG. 2 is a schematic constructional view of the simulator of the electric contact.

The copper plate was pretreated in such a manner that the surface thereof was polished with an india rubber, and then the polished surface was subjected to an ultrasonic cleaning treatment in the presence of acetone. The grease sample was applied (10 mg/cm$^2$) to the pretreated surface of the copper plate. The applied copper plate was left for 200 hours at 60° C. (relative humidity: 95%) or 100° C., and then the contact resistance of the copper plate was measured by means of the CRS-113-AL type simulator for electric contact (Yamazaki Seiki Co., Ltd.). The simulator is shown in FIG. 2. In FIG. 2, (10), (11), (12), and (13) indicate the surface of the copper plate to be measured, a contact made of gold, a synchronous motor, and a resistance meter respectively. The meanings of the marks for the corrosive property of the grease are as follows:

"○": Low contact resistance of 20 mΩ or less was observed under the contact load of 100 g or more.
"x": High contact resistance of 20-200 mΩ was observed under the contact load of 100 g or more.

(4) Durability for ON-OFF action of the switch and durability for soldering

Figure 3:
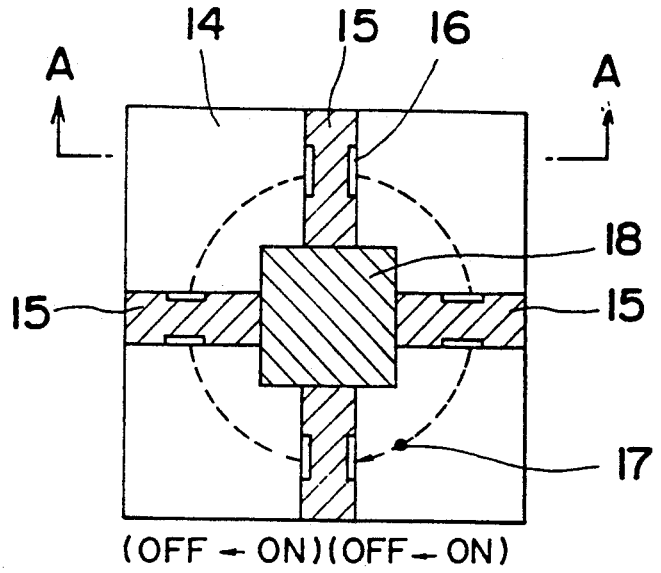
FIG. 3 is a schematic plan of the flat sliding switch used for the test.
Figure 4:
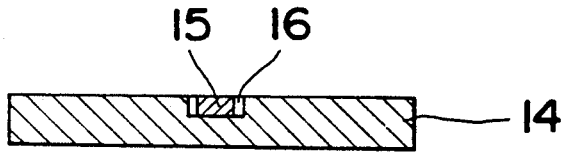
FIG. 4 is a cross section along A—A line in FIG. 3.

A test sample: A test sample of the sliding switch which is similar to the practical sliding switch was prepared, and is shown in FIG. 3 and FIG. 4. FIG. 3 is a schematic plan of the test sample. FIG. 4 is a cross-section of the test sample along A—A line in FIG. 3. In these figures, (14), (15), (16), (17), and (18) indicate a molded plate made of nylon 66 with which an inorganic filler is blended or a molded plate made of PBT resin with which a glass fiber is blended, a fixed contact made of copper, air gap, rotatable contacts made of copper, and a fixed contact respectively. The sample grease was uniformly applied to the surfaces of the molded plate (14) and the fixed contact (15) made of copper, and then the fixed contact (18) was soldered to the fixed contact (15) made of copper by means of a soldering iron which melts the applied grease (cf. FIG. 3).

Figure 5:
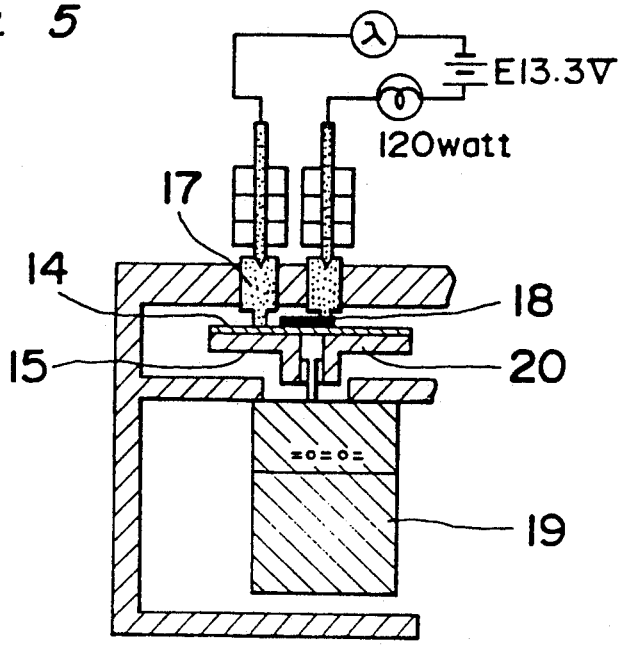
FIG. 5 is a schematic cross section of the apparatus used in the test for repetitive durability of the flat sliding switch.

An apparatus for the test: The test sample prepared as mentioned above was subjected to the durability test using the apparatus shown in FIG. 5. Two test samples were prepared for each grease sample. The test sample was mounted on a rotor (20) fixed to a motor (19). The predetermined load was switched by applying the load as shown in FIG. 5 and by rotating the motor (19) (applied voltage: DC 13.3 V, load: 120 W lamp). When the motor (19) rotates, one (I) of the rotatable contacts (17) rotates on the surface of the fixed contact (18), and the other (II) rotates on the surfaces of the insulating plate (14) and the fixed contact (15) made of copper to switch the lamp. The insulating property of the breaking parts of the insulating plate was decreased by carbonization of the applied grease, combustive damage of the insulating parts, and adhesion of copper fine powder, said phenomena being caused by generation of arc. The insulation resistance between an insulating site which is 3 mm away from the air gap (16) and the fixed contact (15) was measured by means of 5000 V megger by which more than 1000 MΩ of the insulation resistance cannot be measured. Although the value of more than 1000 MΩ was observed before the durability test, said value was decreased by the aforesaid adhesion of the conductive, carbonized product and copper fine powder. The durable switching times (life time) of the test sample were determined when the insulation resistance was less than 1 MΩ.

The meanings of the marks, which are appeared in Table 2, concerning the durability test are as follows:

"○": The durable switching times of one of the test samples are 50,000 cycle or more, and those of the other are 100,000 cycle or more.

"Δ": The durable switching times of one of the test samples are 100,000 cycle or more, and those of the other are 50,000 cycle or less. (Dispersion of the values was observed.)

"x": The durable switching times of the both test samples are 50,000 cycle or less, or those of one test sample are 60,000 cycle or more, and those of the other are 50,000 cycle or less.

(5) Colorability

The colorability of the grease sample was decided by visually determining whether the colored grease, which was thinly applied to white, molded article made of the resin, was present or not. The mark "○" concerning the colorability in Table 2 means that the applied grease sample on the surface of the molded article can visually be confirmed.

TABLE 2

Figure 6:
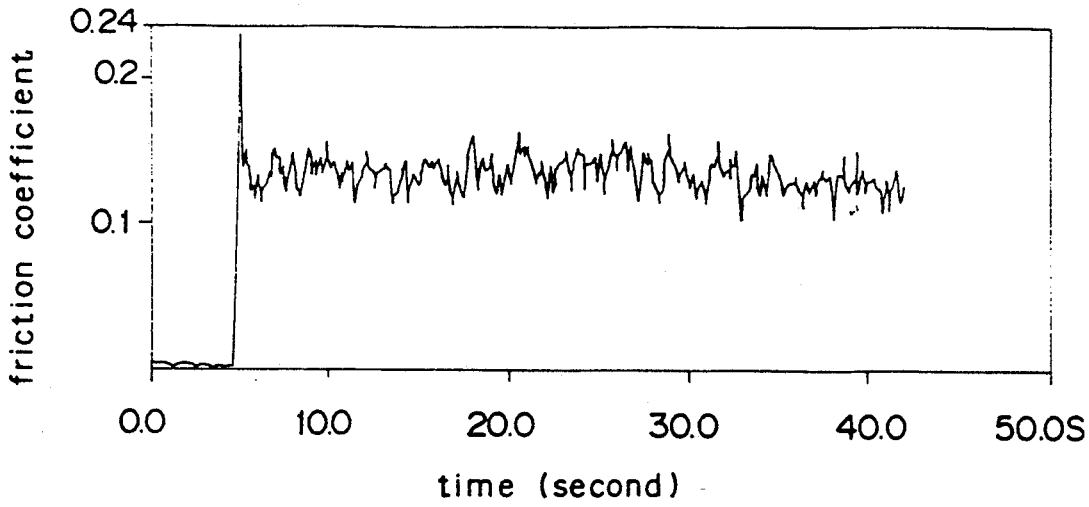
FIG. 6-FIG. 12 are the charts which show the change of dynamic coefficient of friction with the passage of time with respect to the greases 2, 3, 4, 3', 4', 5', and 6' respectively, said greases being prepared in the examples and comparative examples mentioned below.
Figure 7:
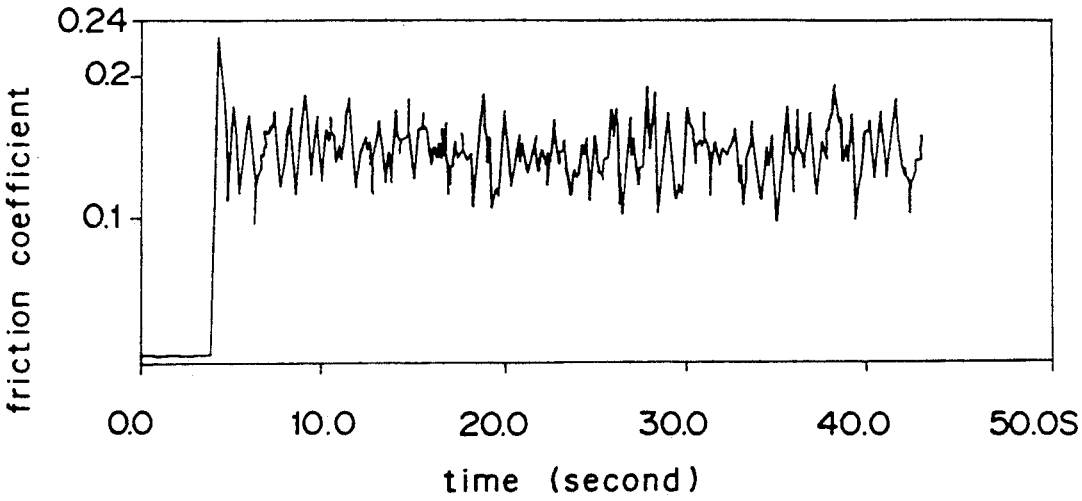
Figure 8:
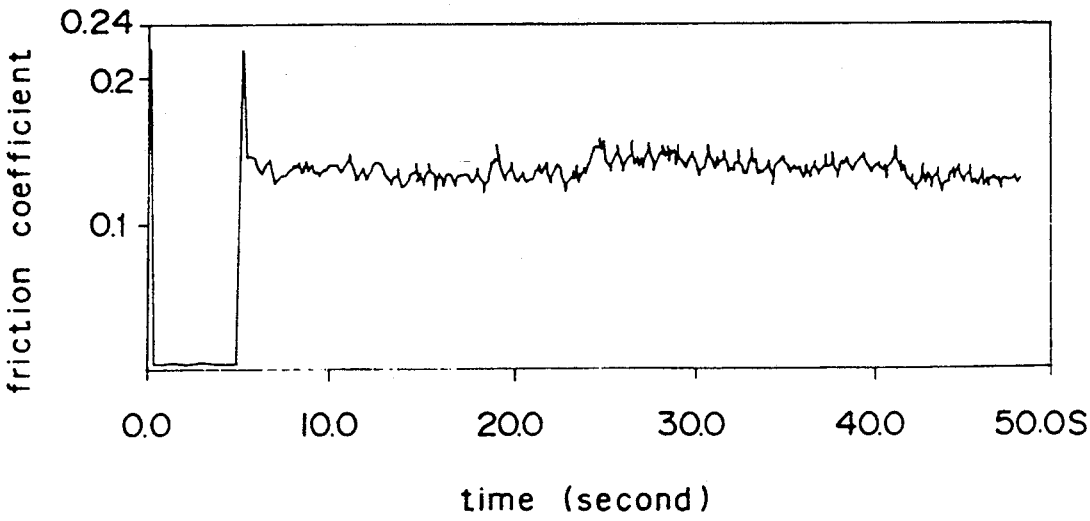
Figure 9:
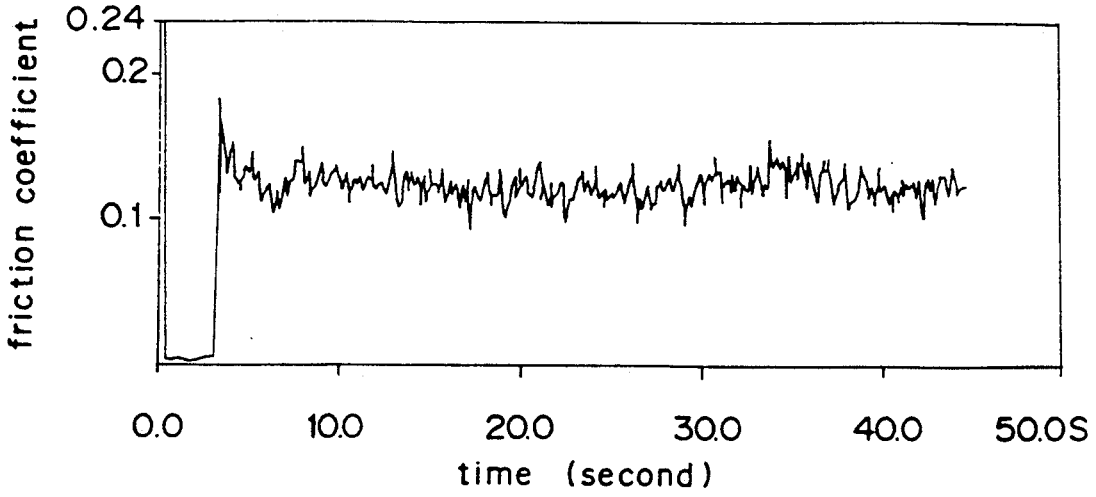
Figure 10:
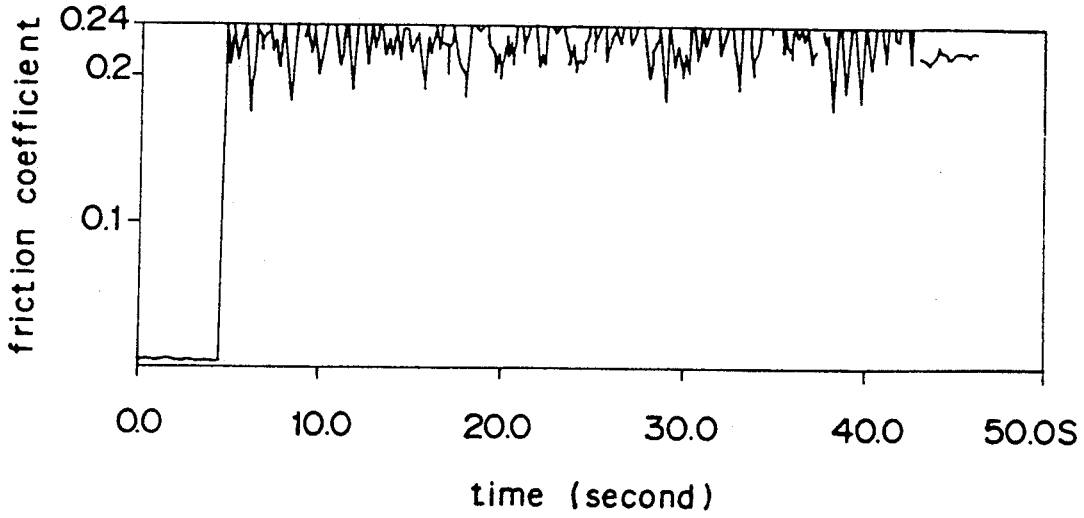
Figure 11:
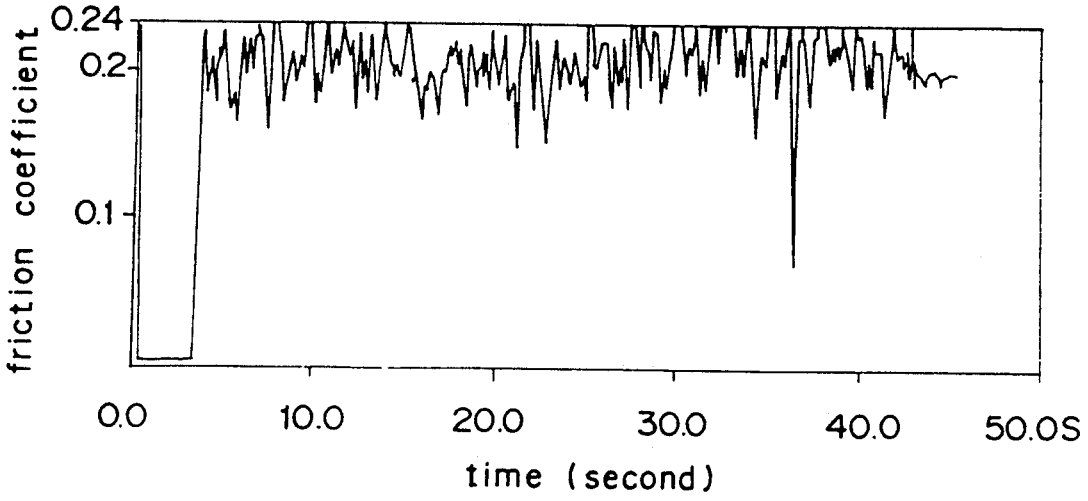
Figure 12:
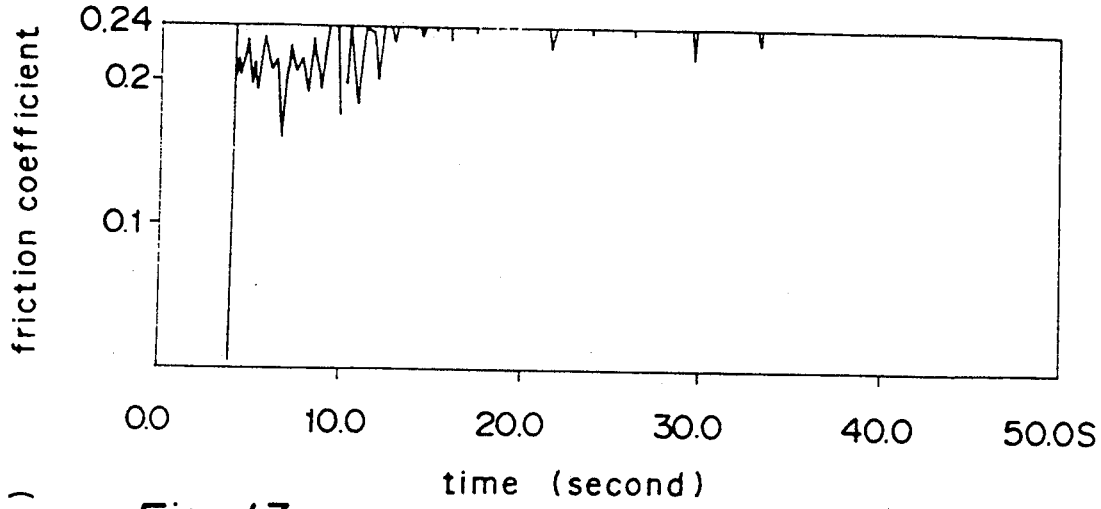
Figure 14:
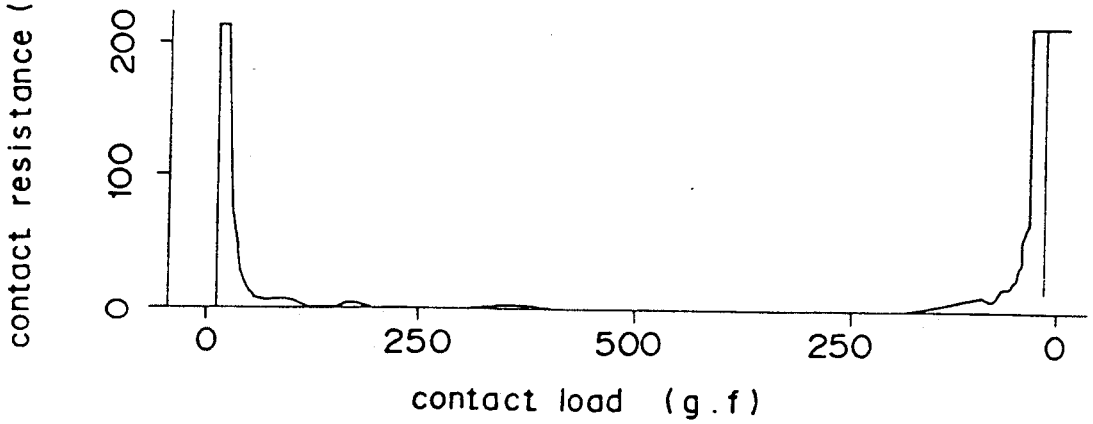
FIG. 14 is the chart which shows the relation between contact load and contact resistance in the corrosion test of the copper plate to which the grease 1 is applied, said test being humidity resistance test of the grease.
Figure 15:
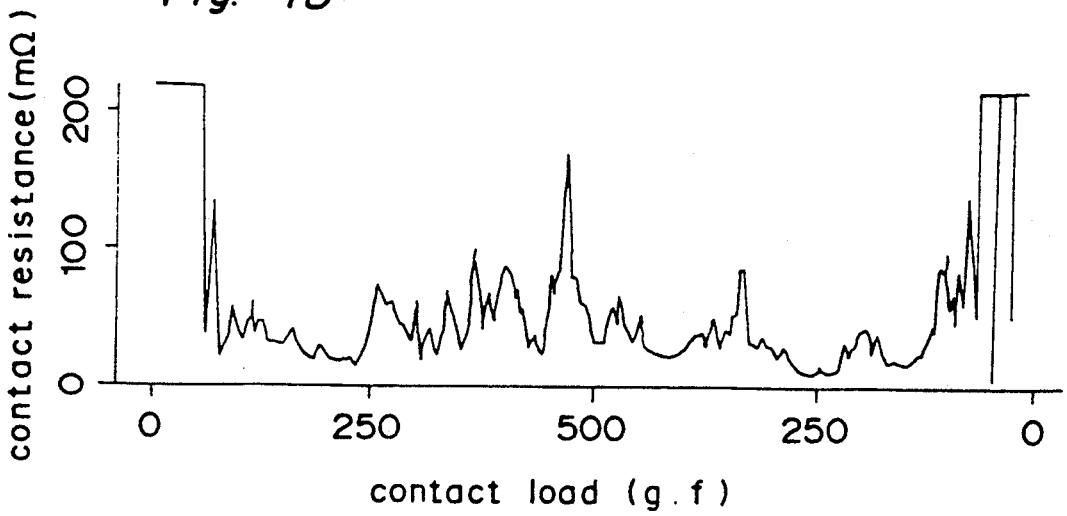
FIG. 15 is the chart which shows the relation between contact load and contact resistance in the corrosion test of the copper plate to which the grease 2' is applied, said test being humidity resistance test of the grease.
Figure 16:
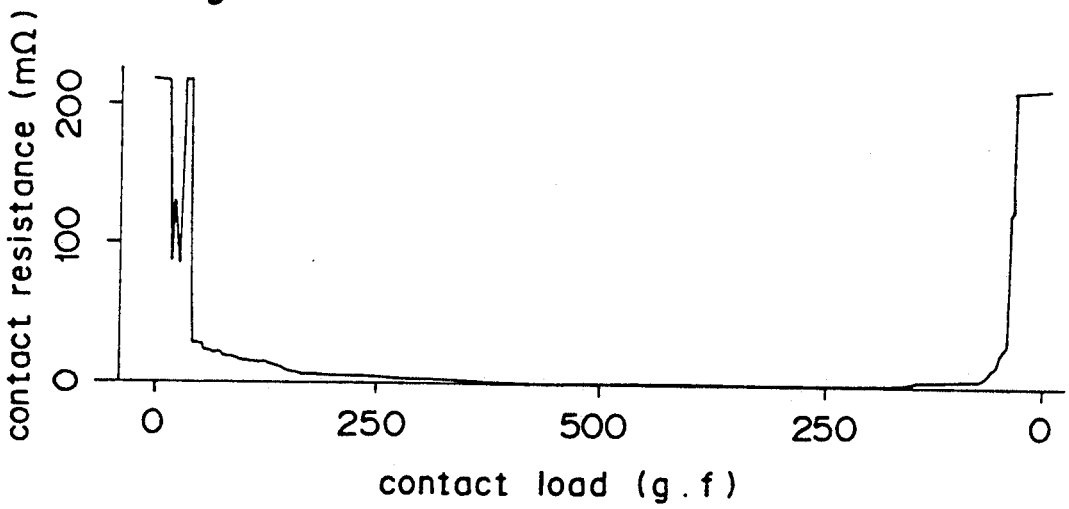
FIG. 16 is the chart which shows the relation between contact load and contact resistance in the corrosion test of the copper plate to which the grease 1 is applied, said test being heat resistance test of the grease.
Figure 17:
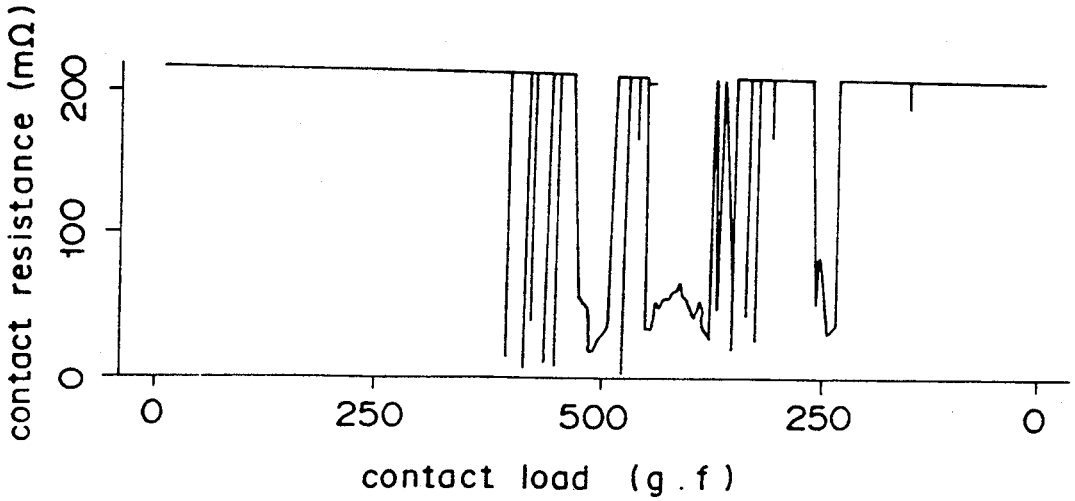
FIG. 17 is the chart which shows the relation between contact load and contact resistance in the corrosion test of the copper plate to which the grease 5' is applied, said test being heat resistance test of the grease.
Figure 18:
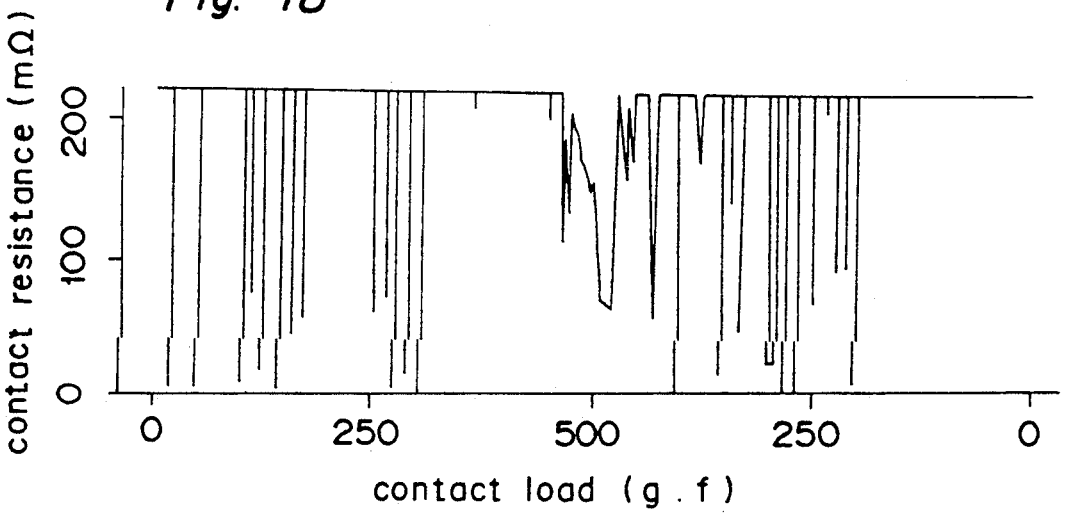
FIG. 18 is the chart which shows the relation between contact load and contact resistance in the corrosion test of the copper plate to which the grease 6' is applied, said test being heat resistance test of the grease.

| Properties of the greases | | Greases | | | | | | | | | | | |
|---|---|---|---|---|---|---|---|---|---|---|---|---|---|
| | | Examples | | | | | Comparative examples | | | | | | |
| | | 1 | 2 | 3 | 4 | 5 | 1' | 2' | 3' | 4' | 5' | 6' | 7' |
| Dynamic friction coefficient | | ○ | ○ | ○ | ○ | ○ | ○ | ○ | ○ | x | Δ | x | ○ |
| Resin compatibility | | | FIG. 6 | FIG. 7 ○ 1) | FIG. 8 | | | | FIG. 9 | FIG. 10 ○ 1) | FIG. 11 | FIG. 12 | |
| Corrosive property for the copper plate | 60° C. (RH 95%), 200 h | ○ FIG. 14 | ○ | ○ | ○ | ○ | ○ | x FIG. 15 | ○ | ○ | ○ | ○ | ○ |
| | 100° C., 200 h | ○ FIG. 16 | ○ | ○ | ○ | ○ | ○ | x | ○ | ○ | x FIG. 17 | x FIG. 18 | ○ |
| Durable switching times | | ○ | ○ | ○ | ○ 2) | ○ | x | x | x | Δ | Δ | ○ | x |
| Max. value of voltage drop (mV)/ | I | 120/6 | 100/20 | 200/11 | 120/15 | 200/12 | 80/2 | 80/2 | 110/6 | 100/18 | 200/14 | >200/15 | 80/3 |
| Durable switching time (× $10^4$) | II | 140/10 | 150/11 | 100/12 | 180/8 | 120/8 | 80/4 | 180/4 | 80/3 | 90/4 | 60/2 | 60/7 | 80/4 |
| Process of dielectric deterioration | | | | 3) | | | | | | 4) | | | |
| Colorability | | — | ○ | ○ | — | — | — | ○ | — | — | ○ | ○ | ○ |

Figure 13:
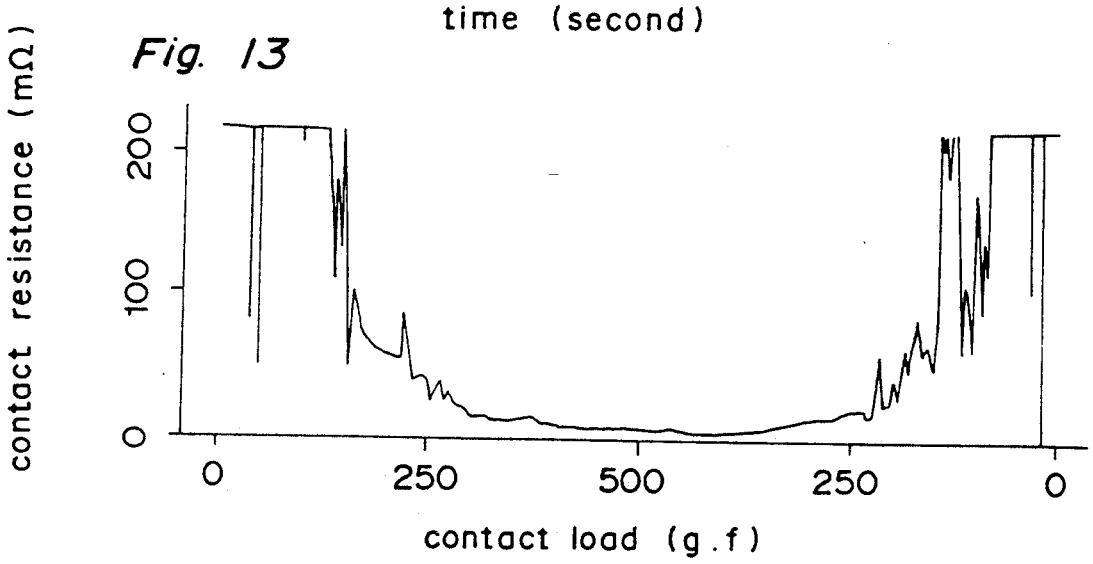
FIG. 13 is the chart which shows the relation between contact load and contact resistance in the corrosion test of the copper plate to which no grease is applied.
Figure 19:
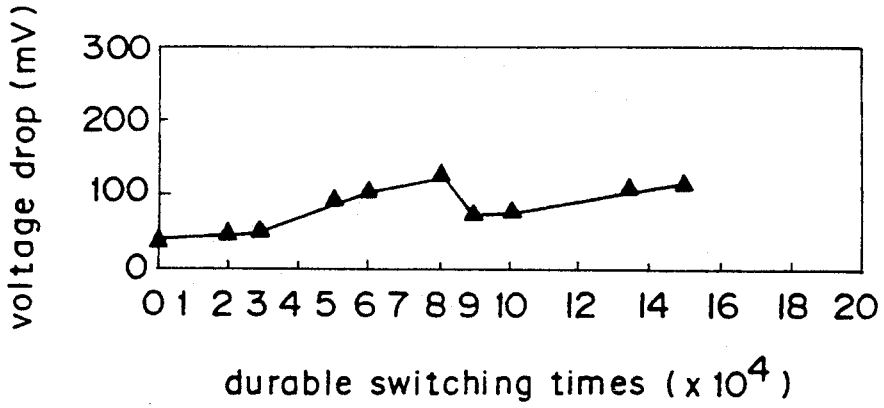
FIG. 19 is the graph which shows the relation between rotational switching times and contact voltage drop in the ON-OFF durability test of the switch to which the grease 4 is applied.
Figure 20:
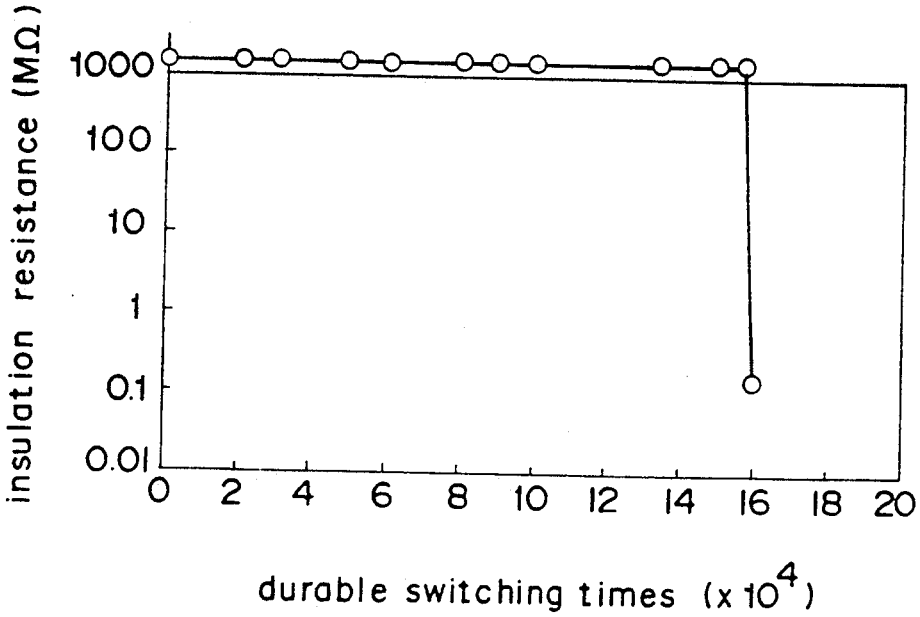
FIG. 20 is the graph which shows the relation between rotational switching times and insulation resistance in the ON-OFF durability test of the switch to which the grease 4 is applied.

1) Stress lowering and stress cracking were not observed.
2) See FIG. 19 and FIG. 20.
3) Unchanged → Exhaustion of the grease → Increase of the voltage drop → Carbonization of the grease → Dielectric deterioration.
4) The insulation resistance rapidly decreased from 1000 MΩ to 0.1 MΩ at about 1000 switching times. In particular, the dielectric deterioration of the sample greases having short life time rapidly proceeded before exhaustion of the greases.
5) The relation between the contact load and the contact resistance of the copper plate to which no grease was applied is shown in FIG. 13.

As stated in detail, the present invention provides the slide contact grease which satisfies all the aforementioned requirements (i)-(vi), including the improved requirement (iv).

The grease according to the present invention is particularly suitable as a grease for a slide contact of the sliding switch of vehicles such as an automobile and the like.

What is claimed is:

1. A grease for a slide contact which comprises (i) a synthetic hydrocarbon oil, (ii) 0.2-3.0 parts by weight of at least one inorganic substance whose mean particle size is 0.3 μ or less, selected from the group consisting of zinc oxide, ferric oxide, and clay minerals which produce magnesium oxide through thermal decomposition thereof at high temperature, (iii) 3-20 parts by weight of 12-hydroxy lithium stearate, and (iv) 0.1-5.0 parts by weight of phenolic and/or amine primary antioxidants, said blending amounts of the ingredients being based on 100 parts by weight of the grease.

2. The grease according to claim 1 wherein said inorganic substance is zinc oxide.

3. The grease according to claim 1 or 2, wherein it further comprises 0.001–0.3 part by weight of an oil-soluble diazo dye.

4. The grease for a slide contact according to claim 1, wherein the synthetic hydrocarbon oil is selected from the group consisting of a poly-α-olefin, a co-oligomer of ethylene and an α-olefin, and polybutene.

5. The grease for a slide contact according to claim 4, wherein the synthetic hydrocarbon oil has a kinematic viscosity of 1.7–10 cSt/100° C.

6. The grease for a slide contact according to claim 1, wherein the at least one inorganic substance has a mean particle size of 0.1 μ.

7. The grease for a slide contact according to claim 1, wherein the at least one inorganic substance is present in an amount from 0.4–1.0 part by weight per 100 parts by weight of the grease.

8. The grease for a slide contact according to claim 1, wherein the 12-hydroxy lithium stearate is present in an amount from 8–15 parts by weight per 100 parts by weight of the grease.

9. The grease for a slide contact according to claim 1, wherein the antioxidant is selected from the group consisting of 2,6-di-t-buty-4-methyl phenol, 4,4-thiobis (3-methyl-6-t-butyl phenol) and alkylated diphenylamine.

10. The grease for a slide contact according to claim 1, wherein the antioxidant is present in an amount from 0.3–2.0 parts by weight per 100 parts by weight of the grease.

* * * * *